US005975455A

United States Patent [19]

Alegre

[11] Patent Number: 5,975,455

[45] Date of Patent: Nov. 2, 1999

[54] DRUM CONSTRUCTION FOR WINCHES USED WITH CARGO TIE-DOWN STRAPS

[75] Inventor: Jose Luis Alegre, Caracas, Venezuela

[73] Assignee: Multiprens C.A., Caracus, Venezuela

[21] Appl. No.: 08/974,334

[22] Filed: Nov. 19, 1997

[51] Int. Cl.[6] ..... B65H 23/04; B61D 45/00; B65D 63/00

[52] U.S. Cl. ..... 242/396.4; 242/407; 242/609.4; 242/613.5; 242/587.2; 410/100; 24/68 CD

[58] Field of Search ..... 242/396.4, 407, 242/609.4, 613.4, 613.5, 587.2; 402/10; 410/100; 24/68 CD

[56] References Cited

U.S. PATENT DOCUMENTS

| | | | |
|---|---|---|---|
| 2,946,563 | 7/1960 | Eaton | 254/164 |
| 3,298,324 | 1/1967 | Schwiebert | 105/369 |
| 4,227,286 | 10/1980 | Holmberg | 24/68 CD |
| 4,510,652 | 4/1985 | von Imperrer | 24/68 CD |
| 4,913,608 | 4/1990 | Royball | 410/103 |
| 5,156,506 | 10/1992 | Bailey | 410/100 |
| 5,205,020 | 4/1993 | Kamper | 24/68 CD |
| 5,282,296 | 2/1994 | Huang | 24/68 CD |
| 5,490,749 | 2/1996 | Arbues | 410/103 |

*Primary Examiner*—John Q. Nguyen
*Attorney, Agent, or Firm*—Shook, Hardy & Bacon LLP

[57] ABSTRACT

An winch drum for a winch used to secure cargo straps which restrain cargo transported on a flatbed vehicle. The winch drum has two D-shaped sections arranged with the flat surfaces spaced apart and facing each other to form a slot for receiving the end of a cargo strap. The arcuate surfaces of the drum sections form a generally cylindrical surface on which the strap can be wound. The flat surfaces of each drum section are formed by inturned sides which are butted together edge to edge. Each drum section has notches at the ends of the flat surfaces. Reinforcing plates are secured in the winch drum by welding them to the drum sections adjacent to the notches. This construction exhibits strength because the reinforcing plates resist any tendency for the tubular drum to collapse.

18 Claims, 2 Drawing Sheets

DRUM CONSTRUCTION FOR WINCHES USED WITH CARGO TIE-DOWN STRAPS

FIELD OF THE INVENTION

This invention relates generally to winches of the type used with cargo tie-down straps to secure cargo on flatbed vehicles. More particularly, the invention is directed to a winch having a structurally enhanced drum construction.

BACKGROUND OF THE INVENTION

It is common in the trucking industry for cargo that is transported on flatbed trucks to be held down by cargo straps drawn tightly over the cargo. These straps are secured at one end to one side of the cargo bed, are drawn over the cargo, and are held tightly by a winch mounted on the other side of the cargo bed. The winch typically has a ratchet and pawl mechanism which locks the winch drum in order to retain the cargo straps in a tight condition.

One type of winch that has been used advantageously is disclosed in U.S. Pat. No. 5,490,749 to Arbues. However, the configuration of the slots through which one end of the cargo strap is threaded can cause problems. The slots in the Arbues winch drum are surrounded by edges having sharp corners that can cut or otherwise damage the cargo strap webbing. This slot configuration does not provide the winch with a strong construction, and the winch drum is thus susceptible to possible structural problems. If the drum is crushed in a collision, the slot edges can easily cut through the cargo strap. The cargo is then released, and the consequences of the collision can be greatly aggravated.

It can also be somewhat difficult to feed the strap through the slots, as the strap end can catch on the edge opposite the slot into which it is initially inserted. The strap end is often doubled over before it is thread through the drum slot. The doubled over webbing naturally tends to spread apart, and this makes it even more susceptible to catching on the slot edges.

Winch drums have also been constructed using two D-shaped sections welded together near the ends and with flat surfaces spaced apart and facing one another to provide opposite sides of the slot that receives the cargo strap. A variation of this construction involves bending the sides again to form flanges that are perpendicular to the flat surfaces on opposite sides of the slot. The primary problem with both of these constructions is that the winch drum can collapse and be crushed when subjected to heavy forces. There is no structure oriented perpendicular to the drum axis in order to provide effective resistance to crushing forces.

SUMMARY OF THE INVENTION

The present invention is directed to a winch drum having a special slot configuration which is reinforced at its opposite ends to increase the strength of the winch drum and its resistance to crushing forces, and to facilitate feeding of the strap through the slot.

In accordance with the invention, the winch drum is constructed of two drum sections which are each formed in the general shape of the letter D. The arcuate portions of the drums cooperate to form a generally cylindrical surface on which cargo straps can be wound. The flat surfaces of the drums are spaced apart and face one another to form a slot which extends continuously through the diameter of the drum with the flat surfaces extending along the entirety of the slot. As a consequence, the flat surfaces provide assistance in guiding of the strap through the slot without difficulty and without catching on any edges or corners.

Each drum section is preferably formed from a flat plate which is stamped in the desired shape and then rolled to form the arcuate surface in its center portion. The flat surface of each drum section is formed by turning the sides of the plate inwardly from the edges of the arcuate portion, with the opposite sides butting up against one another edge to edge.

It is a particular feature of the invention that the winch drum is provided with two reinforcing plates which fit within the drum at the opposite ends of the slot. The plates occupy planes that are perpendicular to the drum axis and thus resist loads tending to crush the drum. The drum sections have notches at the opposite ends of the slot to facilitate welding of the reinforcing plates to the drum sections in a manner to assure strong connections.

DETAILED DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
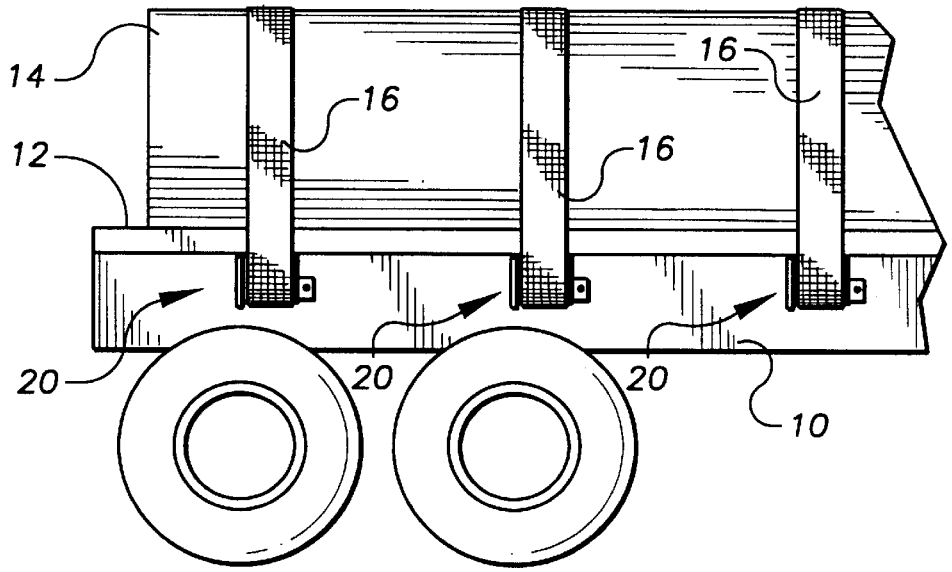
FIG. 1 is a fragmentary side elevational view of a flatbed truck on which a load is secured by flexible cargo straps each tightened by a winch constructed according to a preferred embodiment of the present invention.

Referring now to the drawings in more detail and initially to FIG. 1, numeral 10 designates the frame of a flatbed truck having a flat bed 12 carrying cargo 14. The cargo 14 may take a variety of forms, and it is held down and restrained on the bed 12 by a plurality of flexible cargo straps 16. Each strap 16 has one end hooked or otherwise fixed in a secure manner to the side of the frame 10 opposite the side that is visible in FIG. 1. The straps are drawn over the top of the cargo 14, and each strap 16 is received at its other end and tightened by a winch 20 which is constructed in accordance with the present invention.

Figure 2:
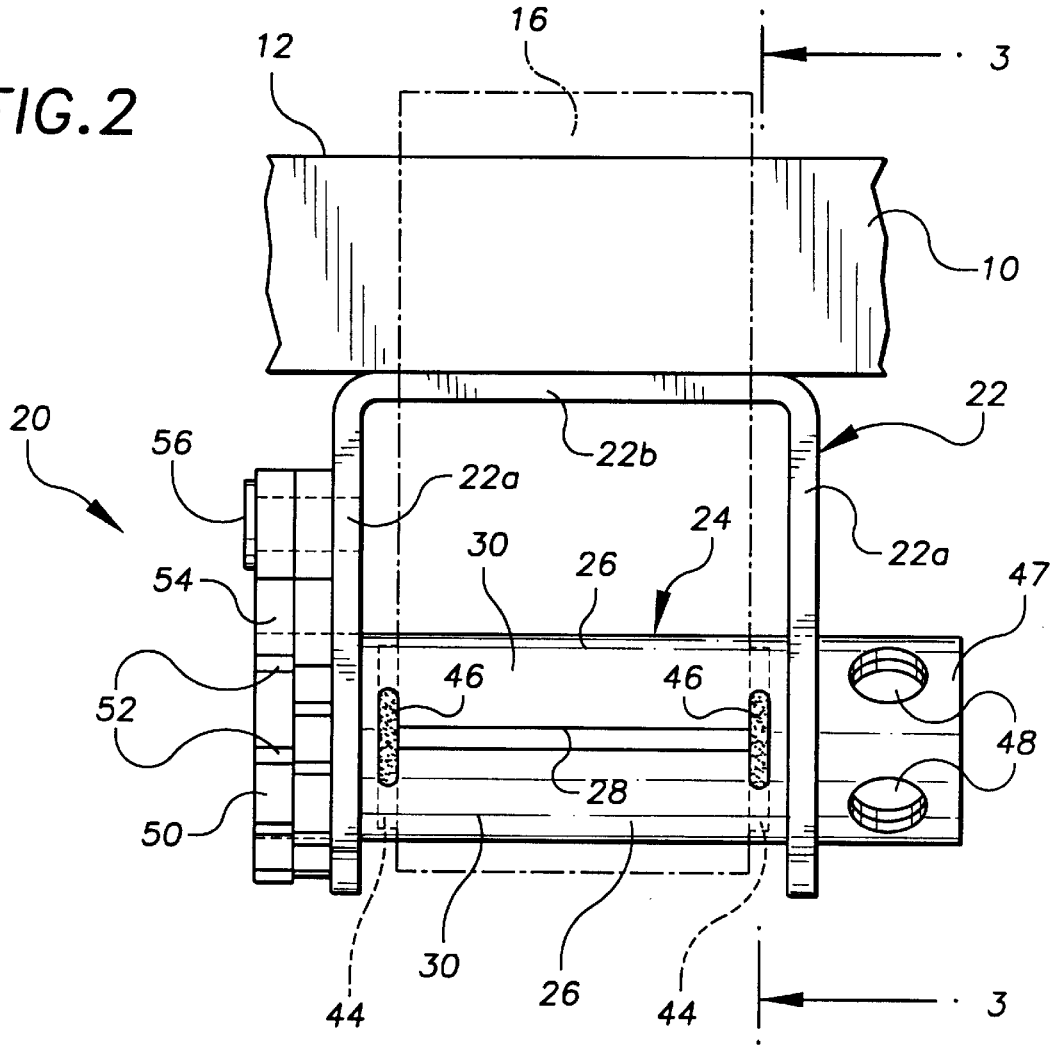
FIG. 2 is a fragmentary elevational view on an enlarged scale showing one of the winches that secure the cargo straps tightly over the cargo, with the cargo strap shown in broken lines.

With reference now more particularly to FIG. 2, each of the winches 20 has a rigid frame 22 preferably constructed of a bent metal plate. The frame 22 may take the shape of an inverted letter U having parallel opposite sides 22*a* and a horizontal bight portion 22*b* which connects the upper edges of the sides 22*a*. The bight portion 22*b* is connected with the frame 10 of the vehicle in a suitable manner such as by bolting or welding it to the underside of the bed 12. Alternatively, the winch frame 22 can be fitted into a track (not shown) which is secured to the vehicle frame and which permits each winch to be adjusted in position forwardly and rearwardly along the length of the vehicle.

Each winch 20 includes a cylindrical winch drum which is generally identified by numeral 24 and which extends between the sides 22*a* of the winch frame 22. The drum 24 is fitted through round openings in the frame sides 22*a* and is able to rotate about a horizontal axis parallel to the longitudinal axis of the vehicle and coincident with the longitudinal axis of the drum 24.

In accordance with the present invention, the winch drum 24 has a special construction which includes a pair of identical drum sections 26. Preferably, each drum section 26 is formed from a flat metal plate which is stamped to provide it with the desired shape. The two drum sections 26 cooperate to provide a slot 28 which extends through the winch drum 24 along its diameter.

Figure 4:
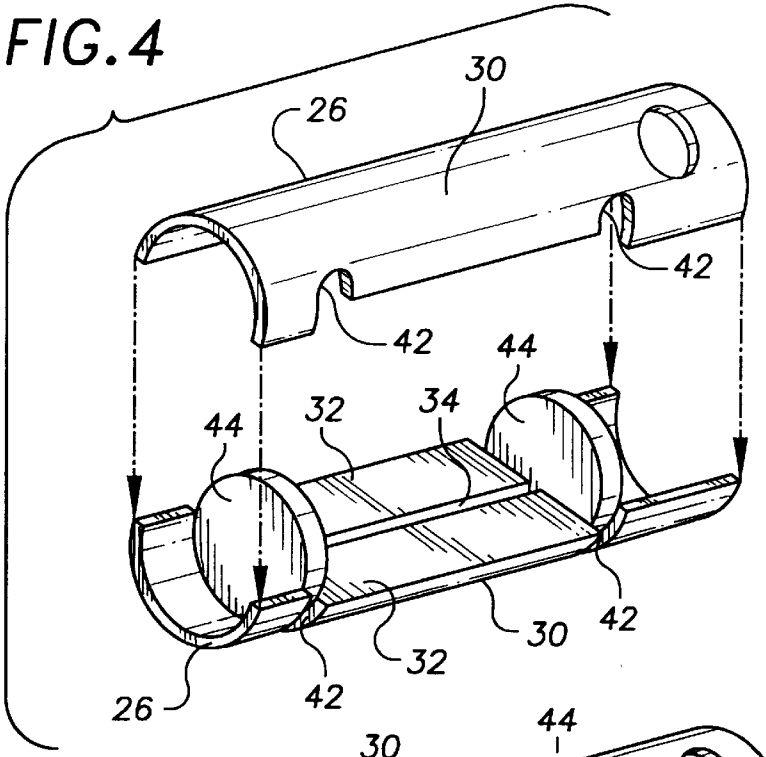
FIG. 4 is an exploded perspective view showing the manner of assembly of the drum of the winch.
Figure 5:
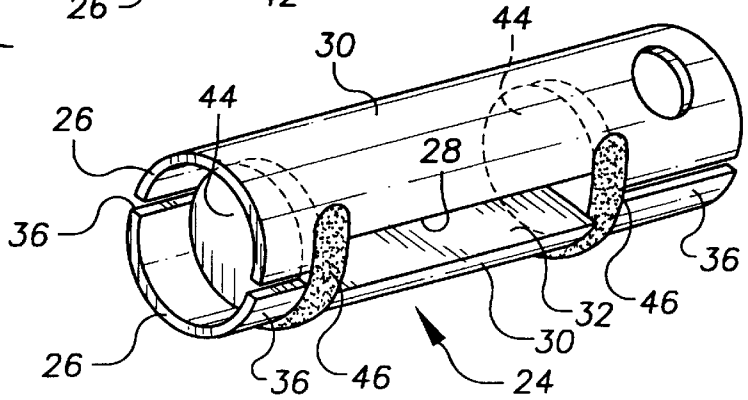
FIG. 5 is a perspective view of the fully assembled winch drum.

As best shown in FIGS. 4 and 5, each drum section 26 presents in cross section the general shape of the letter D in the area of the slot 28. Each section 26 has an arcuate center portion 30 which forms the outer surface of the drum section. Opposite side portions 32 of the plate from which each section 26 is formed are turned inwardly from the edges of the arcuate section 30. The portions 32 are generally flat and terminate in edges that are butted against one another at 34. The drum sections 26 are secured in a manner that the flat surfaces provided by the portions 32 are spaced apart and generally parallel to one another to present the slot 28 between them. By virtue of this construction, the slot 28 is bounded throughout its length and width by the flat surfaces which are formed on its opposite sides by the inturned portions 32 of the drum sections. The size of the slot 28 between the opposing portions 32 can vary but should be large enough to easily receive a cargo strap 16, preferably even if the cargo strap is doubled over.

Each of the side portions 32 is preferably smoothly bent inwardly from the arcuate portion 30 such that curved intersections are provided between each portion 32 and the corresponding arcuate portion 30. This eliminates sharp corners in the area of the slot 28 that could possibly cut or otherwise damage or weaken the cargo strap 16 when it bears against the intersections between portions 30 and 32.

The slot 28 does not occupy the entire length of the winch drum 24, and its length is slightly less than the distance between the opposite sides 22*a* of the winch frame. On opposite ends of the slot 28 at locations adjacent the frame sides 22*a*, the arcuate portions 26 are semi-cylindrical and terminate in edges which are adjacent to the edges of the opposing drum section, as indicated at 36 in FIG. 5. Thus, on opposite ends of the slot 28, the drum sections 26 provide a nearly complete cylinder. In the area of the slot 28, the arcuate portions 30 of the opposing drum sections 26 cooperate to provide a generally cylindrical surface that is interrupted only by the slot 28 and is able to receive the cargo strap 16 wound around it in a roll such as the roll 38 shown in FIG. 3.

At each end of the slot 28, a pair of notches 42 (FIG. 4) are formed in each of the drum sections 26. The notches 42 extend in a circumferential direction on the drum 24 and are thus generally perpendicular to the longitudinal axis of the drum. The slots 42 are adjacent to the edges 36 of the arcuate portions 30 of the drum sections and are also adjacent to the opposite ends of the inturned portions 32 of the drum sections. The notches 42 form transition areas between the ends of the inturned portions 32 and the nearly cylindrical portions of the drum located adjacent to the frame sides 22*a*.

A pair of reinforcing plates for the winch drum 24 may take the form of metal disks 44. Each disk 44 has a diameter substantially equal to the inside diameter of the drum 24. The disks 44 are inserted inside drum 24 and butted against the edges at the opposite ends of the inturned side portions 32. This locates the disks adjacent to the notches 42, as best shown in FIG. 4. The disks 44 are planar members which occupy planes perpendicular to the longitudinal axis of the winch drum 24. The circular periphery of each disk 44 is in contact with the arcuate wall portions 30 of the drum sections 26 along substantially its entire length.

After the two drum sections 26 are assembled with their arcuate portions 30 cooperating to form a cylindrical surface and their flat portions 32 spaced apart and facing each other to form the slot 28, the disks 44 are secured in place by welds 46. The welds 46 are applied through and fill the notches 42 which are located adjacent to the edges of the disks 44. The welds 46 secure each disk 44 to both of the drum sections 26 and also secure the two drum sections together adjacent the edges 36 and the opposite ends of the slot 28.

The notches 42 and welds 46 may be provided on only one side of the drum 24. Alternatively and preferably, the notches 42 are provided in pairs in both edges of each drum section 26 so that each section has four notches and there are two sets of notches at each end of the slot 28 which are at diametrically opposed locations. The welds 46 are then four in number. The notches 42 on one drum section 26 are aligned with the notches on the other drum section to provide convenient access to the disks 44 for applying the welds 46 in a manner to assure a strong connection.

As shown in FIG. 2, an enlarged collar is fitted around and secured to one end of the winch drum 24 at a location adjacent to the outside surface of one of the frame sides 22*a*. The collar 47 fits closely and fully around the arcuate portions 30 on the end of the drum 24 where the arcuate portions form a nearly complete cylinder. Collar 47 may be welded on its end to both of the arcuate portions 30, thus helping to secure the drum sections 26 together. The welds 46 assure that the drum sections 26 remain fixed while the collar is applied and secured in place. The collar 47 is larger in diameter than the drum 24 and is too large to fit through the opening in the frame side 22*a* through which the drum 24 extends. The collar 47 has diametrically opposed openings 48 (see FIG. 2) through which a cylindrical rod or the like (not shown) can be extended and used as a lever for turning of the winch drum 24.

A ratchet wheel 50 is secured on the end of the winch drum 24 opposite the end which carries the collar 47. The ratchet wheel 50 is fitted closely and fully on the cylindrical end portion of the drum 24 at a location adjacent to the outside surface of one of the frame sides 22*a* where the arcuate portions 30 form a nearly complete cylinder. The ratchet wheel 50 may be welded on its end to both of the drum sections 26, thus assisting in securing of the drum sections together. The collar 47 and ratchet wheel 50 retain the winch drum 24 against axial movement relative to the frame 22, although the drum is able to rotate as previously indicated.

As described more fully in U.S. Pat. No. 5,490,749 to Arbues, which is incorporated by reference, the ratchet wheel 50 may have two sets of staggered ratchet teeth 52 which are located in offset planes.

A pawl 54 cooperates with the ratchet wheel 50 in order to lock the winch drum 24 against rotation in a direction to unwind the cargo strap 16. The pawl is pivotally secured at one end to a pivot coupling 56 which is secured to the frame side 22*a*. The coupling 56 has an axis parallel to the axis of the winch drum and has an enlarged head in order to retain the pawl adjacent to the outer surface of the frame side 22*a*. As described more fully in the aforementioned Arbues patent, the pawl 54 may have two staggered sets of teeth that interlock with the teeth 52 of ratchet wheel 50 when the pawl is in the locking position shown in FIG. 2. The interaction between the teeth of the wheel and pawl prevents the ratchet wheel 50 from turning in one direction but allow turning in the opposite direction, with the teeth slipping in and out of meshing engagement. The pawl 54 can be pivoted upwardly about the coupling 56 to a release position wherein its teeth are displaced from the ratchet wheel teeth, and the winch drum 24 is then released so that it can rotate in both directions.

In use, the winch 20 acts to retain cargo strap 16 in a tight condition in order to restrain the cargo 14. After one end of the cargo strap is hooked to one side of the vehicle frame, the strap 16 is drawn over the cargo 14, and its opposite end 60 (see FIG. 3) is threaded through the slot 28. The winch drum 24 may be turned by hand in a counterclockwise direction as viewed in FIG. 3 in order to wind the strap 16 around the winch drum 24 to form a roll 38 on the drum. The slot 28 holds the strap end 60 in order to prevent the strap from slipping as it is wound around the winch drum. After the winch drum has been turned as far as possible by hand, a rod or other tool is extended through the collar openings 48 and used as a lever to turn the collar 47 in order to additionally rotate the winch drum 24 until the strap 16 is tightened as fully as possible. Due to the influence of gravity, the pawl 54 is naturally engaged such that its teeth mesh with the ratchet wheel teeth. As the winch drum is tightened to tighten the cargo strap 16, the ratchet wheel teeth are able to slip relative to the pawl teeth.

The manner in which the slot 28 is formed involves providing the inturned portions 32 on each drum section 26 such that each drum section in the area of the slot is in the form of a substantially semi-cylindrical tube. This structure exhibits considerably more strength than an arcuate plate that is devoid of inturned portions such as 32. The provision of the reinforcing plates (disks 44) increases the strength significantly. Because the disks occupy planes perpendicular to the drum axis, they exhibit great resistance to forces tending to collapse or crush the winch drum. Consequently, the construction of the winch drum 24 provides structural strength that is able to withstand the forces to which the winch drum is subjected in use.

Figure 3:
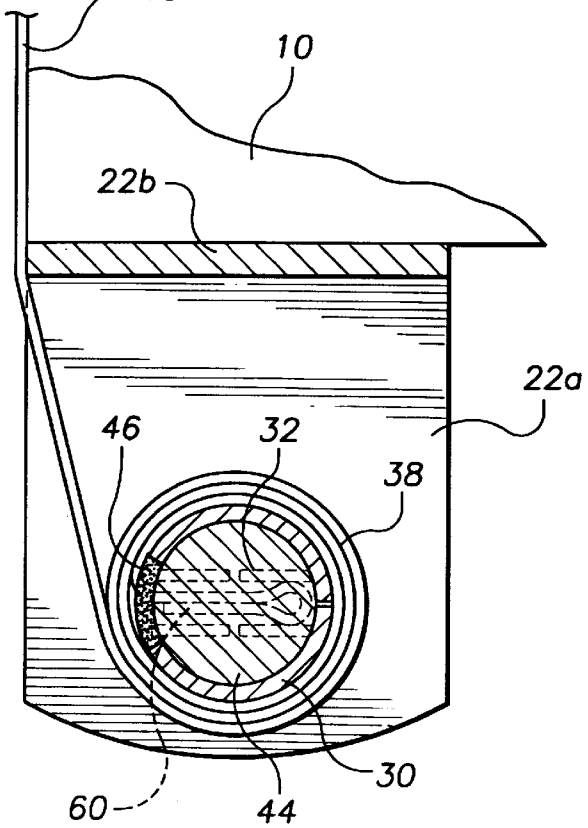
FIG. 3 is a fragmentary sectional view of the winch and a portion of the vehicle bed taken generally along line 3—3 of FIG. 2.

The inturned side portions 32 provide substantially flat guide surfaces that border the opposite sides of the slot 28 so that there are no edges or corners on which the end portion of the cargo strap may catch. The disks 44 provide boundaries at the opposite ends of the slot 28 that prevent the strap from accidentally entering the fully cylindrical opposite end portions of the drum and possibly catching on something. It is common for the end 60 of the cargo strap to be doubled over as depicted in FIG. 3, and the end portion of the strap has a tendency to spread apart when doubled over, thus enhancing the possibility of the strap becoming caught.

Although the reinforcing plates for the winch drum have been shown and described as disks, other shapes are possible. For example, square plates can be substituted in place of the disks, as can a variety of other shapes.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A winch construction for a cargo tie-down system used to secure cargo on a vehicle and including a flexible strap having opposite first and second end portions with said first end portion secured to the vehicle and the strap drawn over the cargo, said winch construction comprising:

a winch frame secured to the vehicle;

a winch drum which includes a pair of opposing drum sections having arcuate outer surfaces cooperating to provide a generally cylindrical drum surface on which the strap can be wound and generally flat surfaces spaced apart and facing one another to present a slot through said drum for receiving the second end portion of the strap, said flat surfaces terminating in opposite ends;

a pair of reinforcing plates secured to said winch drum adjacent said opposite ends of the flat surfaces to reinforce and strengthen the winch drum and present boundary surfaces at opposite ends of said slot, said plates occupying planes oriented substantially perpendicular to the axis of said generally cylindrical drum surface and each reinforcing plate having a substantially circular shape and a perimeter located adjacent to said drum sections;

means for mounting said winch drum for rotation on the winch frame;

a ratchet wheel carried on said winch drum and presenting peripheral ratchet teeth; and a pawl having a plurality of pawl teeth, said pawl being connected with said winch frame for movement between an engaged position wherein said pawl teeth mate with said ratchet teeth to lock the winch drum against rotation in a direction to unwind the strap from the drum, and a release position wherein the drum can rotate.

2. A winch construction as set forth in claim 1, wherein said reinforcing plates are welded to said drum sections.

3. A winch construction as set forth in claim 1, wherein said reinforcing plates are welded to said drum sections.

4. A winch construction as set forth in claim 1, including a notch in at least one drum section adjacent one end of said flat surfaces.

5. A winch construction as set forth in claim 4, wherein at least one of said plates is welded to at least one of said drum sections adjacent said notch.

6. In a winch of the type having a frame secured to a cargo vehicle, a winch drum rotatable on the frame to wind a flexible strap on the drum to tie down cargo carried on the vehicle, and a ratchet and pawl mechanism for locking the drum, an improved winch drum construction comprising:

a pair of opposing drum sections having arcuate outer surfaces cooperating to provide a generally cylindrical drum surface for receiving and winding the strap thereon, said drum surface having a longitudinal axis;

substantially flat surfaces on said drum sections spaced apart and facing one another to present a slot through the drum for receiving an end portion of the strap, said flat surfaces terminating in opposite ends; and a pair of reinforcing plates secured to said drum sections adjacent said opposite ends of the flat surfaces to reinforce and strengthen the winch drum and present boundary surfaces at opposite ends of said slot, said plates occupying planes oriented substantially perpendicular to the axis of said generally cylindrical drum surface and each reinforcing plate having a substantially circular shape and a perimeter located adjacent to said drum sections.

7. A winch drum construction as set forth in claim 6, including a pair of notches in each of said drum sections adjacent the opposite ends of said flat surfaces.

8. A winch drum construction as set forth in claim 7, wherein both plates are respectively welded to both drum sections in said notches.

9. A winch construction as set forth in claim 8, wherein each reinforcing plate has a substantially circular shape and is adjacent to said drum sections around substantially the entire perimeter of the plate.

10. In a winch of the type used in a cargo tie-down system which includes a flexible strap drawn over cargo carried on a vehicle, the improvement comprising:

a rigid frame secured to the vehicle;

a winch drum which includes a pair of opposing drum sections each having an arcuate center portion and a pair of generally flat in turned side portions butted against one another such that each drum section has the general shape in cross-section of the letter D, said side portions having opposite ends;

said winch drum being mounted on the frame for rotation with said arcuate center portions cooperating to provide a generally cylindrical drum surface on which the strap may be wound and said side portions of each drum section spaced apart and parallel to the side portions of the other drum section to present a slot through the winch drum bounded by the side portions;

a pair of reinforcing plates secured to said winch drum adjacent said opposite ends of the side portions to reinforce and strengthen the winch drum and present boundary surfaces at opposite ends of said slot, said plates occupying planes oriented substantially perpendicular to the axis of said generally cylindrical drum surface and each reinforcing plate having a substantially circular shape and a perimeter located adjacent to said drum sections around substantially the entire perimeter of the plate; and ratchet and pawl means for selectively locking the drum against rotation in a direction to unwind the strap.

11. An improvement as set forth in claim 10, wherein said reinforcing plates are welded to said drum sections.

12. An improvement as set forth in claim 10, wherein said reinforcing plates are welded to said drum sections.

13. An improvement as set forth in claim 10, including a notch in at least one drum section adjacent one end of said side portions.

14. An improvement as set forth in claim 13, wherein at least one of said plates is welded to at least one of said drum sections adjacent said notch.

15. An improvement as set forth in claim 10, including a pair of notches in each drum section adjacent the opposite ends of said side portions.

16. An improvement as set forth in claim 15, wherein both plates are respectively welded to both drum sections in said notches.

17. In a winch of the type having a frame secured to a cargo vehicle, a winch drum rotatable on the frame to wind a flexible strap on the drum to tie down cargo carried on the vehicle, and a ratchet and pawl mechanism for locking the drum, an improved winch drum construction comprising:

a pair of opposing drum sections having arcuate outer surfaces cooperating to provide a generally cylindrical drum surface for receiving and winding the strap thereon, said drum surface having a longitudinal axis;

substantially flat surfaces on said drum sections spaced apart and facing one another to present a slot through the drum for receiving an end portion of the strap, said flat surfaces terminating in opposite ends; and a pair of reinforcing plates secured to said drum sections adjacent said opposite ends of the flat surfaces to reinforce and strengthen the winch drum and present boundary surfaces at opposite ends of said slot, said plates occupying planes oriented substantially perpendicular to the axis of said generally cylindrical drum surface; and a pair of notches in each of said drum sections adjacent the opposite ends of said flat surfaces, both plates being respectively welded to said drum sections in said notches.

18. In a winch of the type used in a cargo tie-down system which includes a flexible strap drawn over cargo carried on a vehicle, the improvement comprising:

a rigid frame secured to the vehicle;

a winch drum which includes a pair of opposing drum sections each having an arcuate center portion and a pair of generally flat in turned side portions butted against one another such that each drum section has the general shape in cross-section of the letter D, said side portions having opposite ends;

said winch drum being mounted on the frame for rotation with said arcuate center portions cooperating to provide a generally cylindrical drum surface on which the strap may be wound and said side portions of each drum section spaced apart and parallel to the side portions of the other drum section to present a slot through the winch drum bounded by the side portions;

a pair of reinforcing plates secured to said winch drum adjacent said opposite ends of the side portions to reinforce and strengthen the winch drum and present boundary surfaces at opposite ends of said slot, said plates occupying planes oriented substantially perpendicular to the axis of said generally cylindrical drum surface; and ratchet and pawl means for selectively locking the drum against rotation in a direction to unwind the strap; and a pair of notches in each drum section adjacent the opposite ends of said side portions, both plates being respectively welded to both drum sections in said notches.

* * * * *